US008852298B2

(12) United States Patent
Cunningham et al.

(10) Patent No.: US 8,852,298 B2
(45) Date of Patent: Oct. 7, 2014

(54) FUEL COMPOSITION CONTAINING IRON AND MANGANESE TO REDUCE SPARK PLUG FOULING

(75) Inventors: Lawrence J. Cunningham, Mechanicsville, VA (US); Allen A. Aradi, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 350 days.

(21) Appl. No.: 11/427,630

(22) Filed: Jun. 29, 2006

(65) Prior Publication Data

US 2008/0000148 A1 Jan. 3, 2008

(51) Int. Cl.

| | |
|---|---|
| ***C10L 1/18*** | (2006.01) |
| ***C10L 1/12*** | (2006.01) |
| ***C10L 1/30*** | (2006.01) |
| ***C10L 10/10*** | (2006.01) |

(52) U.S. Cl.

CPC ..... *C10L 1/305* (2013.01); *C10L 10/10* (2013.01); *C01L 10/00* (2013.01)

USPC ..... 44/359; 44/354; 44/358

(58) Field of Classification Search

USPC ..... 44/432, 359, 347, 360, 373, 354, 358

See application file for complete search history.

(56) References Cited

U.S. PATENT DOCUMENTS

| | | | | |
|---|---|---|---|---|
| 2,818,417 | A | 12/1957 | Brown et al. | |
| 4,139,349 | A | 2/1979 | Payne | |
| 4,568,357 | A | 2/1986 | Simon | |
| 4,674,447 | A | 6/1987 | Davis | |
| 5,113,803 | A | 5/1992 | Hollrah et al. | |
| 5,599,357 | A | 2/1997 | Leeper | |
| 5,679,116 | A * | 10/1997 | Cunningham et al. | 44/359 |
| 5,944,858 | A * | 8/1999 | Wallace | 44/359 |
| 2002/0112466 | A1 * | 8/2002 | Roos et al. | 60/274 |

FOREIGN PATENT DOCUMENTS

| | | |
|---|---|---|
| EP | 0 466 512 B1 | 1/1992 |
| GB | 934375 | 8/1963 |
| PL | 108076 | 11/1980 |
| RU | 2276683 | 5/2006 |
| WO | WO2004/055136 A1 * | 7/2004 |

* cited by examiner

*Primary Examiner* — James Goloboy
*Assistant Examiner* — Latosha Hines
(74) *Attorney, Agent, or Firm* — MH2 Technology Law Group, LLP

(57) ABSTRACT

There is disclosed a method of reducing the conductivity of deposits formed from the combustion of a fuel comprising an iron-containing compound, said method comprising adding a manganese-containing compound to the fuel.

17 Claims, No Drawings

FUEL COMPOSITION CONTAINING IRON AND MANGANESE TO REDUCE SPARK PLUG FOULING

FIELD OF THE DISCLOSURE

The present disclosure relates to the use of a manganese-containing compound to improve spark plug performance and reduce the conductivity of deposits in the presence of an iron-containing compound in a fuel being combusted.

BACKGROUND OF THE DISCLOSURE

The use of ferrocene compounds in fuels is known. However, the iron containing deposits formed from ferrocene can form a conductive coating on the sparkplug surfaces leading to sparkplug failure.

What is needed is a fuel composition wherein the life of the spark plug is extended, for example, because deposits formed on the spark plug are reduced and/or the conductivity of the spark plug deposits are reduced thereby resulting in a reduction of spark plug misfires.

SUMMARY OF THE DISCLOSURE

In accordance with the disclosure, there is provided herein a method of reducing the conductivity of deposits formed from the combustion of a fuel comprising an iron-containing compound, said method comprising adding a manganese-containing compound to the fuel.

In addition is provided herein a fuel composition comprising a fuel, ferrocene, in an amount up to about 35 mg iron/liter of fuel, and methylcyclopentadienyl manganese tricarbonyl.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The present disclosure is directed to extending the life of a spark plug and reducing conductivity of combustion generated deposits by the use of combinations of organometallic compounds in fuels. In particular, the fuel can comprise at least two organometallic compounds, wherein each of the at least two organometallic compounds is different. In an aspect, the fuel can comprise an iron-containing compound such as but not limited to ferrocene, wherein a manganese-containing compound can be provided to the fuel. In a further aspect, the manganese-containing compound is or comprises methylcyclopentadienyl manganese tricarbonyl (MMT®).

Non-limiting examples of organometallic compounds include those having an organo group and at least one metallic ion or atom. In an aspect, organo groups in the organometallic compounds include, but are not limited to, alcohols, aldehydes, ketones, esters, anhydrides, sulfonates, phosphonates, chelates, phenates, crown ethers, naphthenates, carboxylic acids, amides, acetyl acetonates, and mixtures thereof.

Organometallic iron compounds, such as ferrocene, are known, for example, for octane enhancement (U.S. Pat. No. 4,139,349, the disclosure of which is hereby incorporated by reference in its entirety). Ferrocene $Fe(C_5H_5)_2$ comprises two cyclopentadienyl rings bound on opposite sides of a central iron atom and forming an organometallic sandwich compound.

The ferrocene can be present in a fuel composition in any desired or effective amount. In an aspect, the fuel can be treated with from about 2 mg iron/liter of fuel to about 35 mg iron/liter of fuel, for example from about 5 mg/liter to about 25 mg/liter, and as a further example from about 10 mg/l to about 20 mg/l The fuel composition can comprise an organometallic compound that is different from ferrocene. In an aspect, the organometallic compound can be a manganese-containing compound. In the case of a manganese-containing compound, there are numerous monoatomic compounds that include methylcyclopentadienyl manganese tricarbonyl, manganocene, and many other monomanganese organometallics that exist in the literature. There are also binuclear metallics such as manganese heptoxide ($Mn_2O_7$), manganese decacarbonyl ($Mn_2(CO)_{10}$), etc. An example of a trinuclear manganese cluster is manganese 11 citrate, ($Mn_3(C_6H_5O_7)_2$).

Manganese-containing organometallic compounds can include, for example, manganese tricarbonyl compounds. Such compounds are taught, for example, in U.S. Pat. Nos. 4,568,357; 4,674,447; 5,113,803; 5,599,357; 5,944,858 and European Patent No. 466 512 B1, the disclosures of which are hereby incorporated by reference in their entirety.

Suitable manganese tricarbonyl compounds which can be used include, but are not limited to, cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. One example is the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl, and ethylcyclopentadienyl manganese tricarbonyl, etc.

Preparation of such compounds is described in the literature, for example, U.S. Pat. No. 2,818,417, the disclosure of which is incorporated herein in its entirety.

Additional non-limiting examples of manganese-containing compounds include non-volatile, manganese-containing compounds such as bis-cyclopentadienyl manganese, bis-methyl cyclopentadienyl manganese, manganese naphthenate, manganese II citrate, etc, that are either water or organic soluble. Further examples include non-volatile, manganese-containing compounds embedded in polymeric and/or oligomeric organic matrices, such as those found in the heavy residue from the column distillation of crude MMT®.

When formulating additives to be used in one embodiment of the methods, compositions and systems of the present disclosure, the manganese-containing compounds are employed in any desired or effective amount sufficient to lower the conductivity of combustion-derived products such as spark plug deposits compared to deposits formed from combustion of fuel treated with ferrocene alone and otherwise generally extend the life of a spark plug An exemplary treatment rate of the manganese-containing compound can be less than or equal to 36 mg of manganese/liter of fuel, for example less than 25 mg of manganese/liter of fuel, and as a further example about 1 to about 20 mg of manganese/liter of fuel.

Reference is also made throughout of the term "reduced" in the context of operation of an engine and/or spark plug. The term "reduced" means a reduction in the operation of a system relative to the operation of a similar system that has an iron containing compound, but does not have a manganese-containing compound combusted in combination with an iron containing compound. "Reduced" operation includes, but is not limited to reduction in the number of mis-fires, and/or a reduction in the conductivity of the deposits appearing or produced on the spark plugs.

By "hydrocarbonaceous fuel" herein is meant hydrocarbonaceous fuels such as, but not limited to, fuel oils for bunker, marine, utility boilers, furnaces, industrial burners boilers, and waste oils and liquid chemicals for incinerator start-up and/or combustion balancing, synthetic fuels such as gas to liquids (GTL), biomass to liquids (BTL), coal to liquids (CTL), oil shale derived fuels, diesel fuel, jet fuel, alcohols, ethers, kerosene, low sulfur fuels, ultra low sulfur fuels, synthetic fuels, such as Fischer-Tropsch fuels, liquid petroleum gas, fuels derived from coal, fuels derived from synthetic crude, tar sands, oil shale, syngas, genetically engineered biofuels such as biobutanol, crops and extracts therefrom, natural gas, propane, butane, unleaded motor and aviation gasolines, and so-called reformulated gasolines which typically contain both hydrocarbons of the gasoline boiling range and fuel-soluble oxygenated blending agents, such as alcohols, such as methanol, ethanol, propanol, butanol, and ethers and other suitable oxygen-containing organic compounds. Oxygenates suitable for use in the fuels of the present disclosure include methanol, ethanol, n-propanol, isopropanol, n-butanol, isobutanol, t-butanol, biobutanol, higher carbon number alcohols, mixed alcohols, methyl tertiary butyl ether, tertiary amyl methyl ether, ethyl tertiary butyl ether and mixed ethers. Oxygenates, when used, will normally be present in the reformulated gasoline fuel in an amount below about 25% by volume, and for example in an amount that provides an oxygen content in the overall fuel in the range of about 0.5 to about 5 percent by volume. "Hydrocarbonaceous fuel" or "fuel" herein shall also mean any fuel that can be combusted in a spark, compression glow plug ignited engine or other internal combustion engine, By "combustion system" and "apparatus" herein is meant, for example and not by limitation herein Atkinson cycle engines, rotary engines, spray guided, wall guided, and the combined wall/spray guided direct injection gasoline (DIG) engines, turbocharged DIG engines, supercharged DIG engines, homogeneous combustion DIG engines, homogeneous/stratified DIG engines, DIG engines outfitted with piezo-injectors with capability of multiple fuel pulses per injection, DIG engines with EGR, DIG engines with a lean-NOx trap, DIG engines with a lean-NOx catalyst, DIG engines with SN-CR NOx control, DIG engines with exhaust diesel fuel after-injection (post combustion) for NOx control, DIG engines outfitted for flex fuel operation (i.e. gasoline, ethanol, methanol, biofuels, synthetic fuels, natural gas, liquefied petroleum gas (LPG), and mixtures thereof), conventional and advanced port-fueled gasoline engines, with and without advanced exhaust after-treatment systems capability, with and without turbochargers, with and without superchargers, with combined supercharger/turbocharger, with and without on-board capability to deliver additive for combustion and emissions improvements, with and without variable valve timing, gasoline fueled homogeneous charge compression ignition (HCCI) engines, Diesel HCCI engines, gasoline HCCI-electric hybrid engines, diesel HCCI-electric hybrid engines, diesel-electric hybrid vehicle, gasoline-electric hybrid vehicle, a two-stroke engine, diesel fuel engines, automotive diesel engines, gasoline fuel engines, stationary generators, gasoline and diesel HCCI, supercharged, turbocharged, gasoline and diesel direct injection engines, engines capably of variable valve timing, leanburn engines, engines capable of inactivating cylinders or any other internal combustion engine, and the like. The hydrocarbonaceous fuel combustion systems that may benefit from the present disclosure include all engines that burn fuel. By "combustion system" herein is also meant any and all internal combustion devices, machines, engines and the like which can combust or in which can be combusted a hydrocarbonaceous fuel.

In an aspect, the combustion system can comprise the hydrocarbonaceous fuel. In an aspect, if the fuel comprises ferrocene, then an effective amount of the manganese-containing compound can be provided to the combustion system and/or the fuel. Alternatively, at least two organometallic compounds can be provided to the combustion system and/or the fuel.

In another embodiment of the present disclosure is provided a method of enhancing the octane rating (Octane Research Number) of a fuel comprising adding to the fuel (a) a manganese-containing compound to deliver up to 36 milligrams of manganese per liter of fuel, and (b) an iron-containing compound to deliver up to 35 milligrams of iron per liter of fuel, whereby the resulting fuel has an Research Octane Number equal to or greater than 6.0, and in another embodiment the RON is greater than 7, and in yet another it is greater than 8.0.

There is also presented by the present disclosure a fuel system comprising a fuel, ferrocene, in an amount of from about 1 to about 35 milligrams of iron per liter of fuel, methylcyclopentadienyl manganese tricarbonyl, and a combustion system able to combust said fuel.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the organometallic compound) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

EXAMPLES

Example 1—Conductivity

Three sample fuel compositions (20 mg Mn/liter of fuel as MMT®; 15 mg Fe/liter of fuel as ferrocene; 20 mg Mn/liter of fuel as MMT® and 15 mg Fe/liter of fuel as ferrocene) were formulated and combusted in a Honda generator, 3.5 HP/2 kW engine. The engines operated so that the spark plug achieved temperatures of 152° C. for 20 minutes and 166° C. for 40 minutes. This cycling was repeated 50 times for a total of 50 hours of operation. The engines used Pennzoil 10W-30 engine oil. After testing each fuel composition, the deposits were scrapped off the spark plugs and sent to SouthWest Research Institute (San Antonio Tex., USA) for conductivity characterizations The conductivity measurements were made on a single-sided interdigitated electrode (4.37 $cm^2$) and the complex permittivity measured at 30° C. and 330° C. over an AC frequency span ranging from about 10 to about 30 k Hz. The total conductivity which might include both electrical and ionic was derived for each frequency from the measured loss factor E (imaginary component of the permittivity vector). The conductivity value was then corrected for the effective contact area of the sample on the electrode.

Generally the low frequency measurements approach the DC conductivity of a material while the high frequency measurement approaches the ionic conductivity.

The results are shown in Table 1.

TABLE 1

| Metal | [mg metal/l] | Temperature ° C. | Frequency Hz | Conductivity pmho/cm |
|---|---|---|---|---|
| Fe | 15 | 30 | 300 | 131 |
| Fe | 15 | 330 | 3000 | 790 |
| Mn | 20 | 30 | 300 | 1 |
| Mn | 20 | 330 | 3000 | 6 |
| Fe/Mn | 15/20 | 30 | 300 | 12 |
| Fe/Mn | 15/20 | 330 | 3000 | 74 |

The deposits' conductivities differed between the fuel compositions tested. The order of deposit conductivity was, Fe>Mn/Fe>Mn. The iron-containing fuel resulted in deposits with the greatest conductivity, more than two orders of magnitude greater than those observed when manganese-containing fuel was used. The conductivity of the deposits obtained from the fuel containing both manganese and iron was about an order of magnitude less than that obtained from use of iron-containing compound alone. The results showed that a fuel composition comprising an iron-containing and a manganese-containing compound reduced the conductivity of the spark plug deposits compared to a fuel composition comprising iron-containing compound alone.

Example 2—Engine Test

In this part of the study, vehicles accumulated mileage on gasoline additized with ferrocene alone and gasoline containing both ferrocene and MMT®.

Initially, the vehicles operated on regular unleaded gasoline blended with ferrocene alone. If an ignition problem was observed the vehicles were rebuilt and operated on gasoline containing both MMT® and ferrocene until either (a) ignition-related problems were encountered, or (b) the vehicles accumulated at least double the mileage without an ignition-related problem.

Each engine (2001 Lexus GS300-3.0 liter, I-6 cylinder, 24 valve; and 2004 VW Jetta-2.0 liter, I-4 cylinder, 8 valves) was rebuilt at the beginning of the test. The intake valves and combustion chambers were cleaned and new spark plugs were installed. The oil was changed after each test and at the vehicle manufacturer (OEM) recommended oil change intervals during the test.

The vehicles accumulated mileage under a mixed driving cycle (BMW Road Cycle: 10% City, 20% Suburban, 70% Highway) on regular unleaded gasoline (regular unleaded gasoline additized with a U.S. EPA LAC level of gasoline detergent). The vehicles' on-board diagnostic ("OBD") systems were used to identify any engine misfire. When the OBD system detected a component malfunction, such as spark plug misfire, a malfunction indicator light (MIL) illuminated on the dashboard alerting the driver of the problem. The results are shown in Table 2 where PO300 is an industry standard code for multiple cylinder misfire detected, and PO304 is an industry standard code for cylinder 4 misfire.

TABLE 2

| Vehicle | Additive(s) | Treat Rate(S) | Mileage | MIL Code* |
|---|---|---|---|---|
| 2001 Lexus | ferrocene | 20 mg/l Fe | 3,075 | P0300 |
| 2001 Lexus | ferrocene/MMT ® | 10 mg/l Fe + 10 mg/l Mn | 10,000 | None |
| 2004 Jetta | ferrocene | 20 mg/l Fe | 9,487 | P0304 |
| 2004 Jetta | ferrocene/MMT ® | 10 mg/l Fe + 10 mg/l Mn | 20,009 | None |

*P0300 Random/Multiple Cylinder Misfire Detected
*P0304 Cylinder 4 Misfire

The vehicles operating on the fuel containing ferrocene alone set a misfire-related MIL light within 10,000 miles of operation. The vehicles operated on the combination of the two fuel additives ran for at least twice the mileage that they operated on with ferrocene alone without an MIL illumination. In fact, the mileage tests for the combination of iron+manganese additives were terminated (at 10,000 and 20,009 miles) without evidence of failure or misfire.

At numerous places throughout this specification, reference has been made to a number of U.S. patents, published foreign patent applications and published technical papers. All such cited documents are expressly incorporated in full into this disclosure as if fully set forth herein.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is noted that, as used in this specification and the appended claims, the singular forms "a," "an," and "the," include plural referents unless expressly and unequivocally limited to one referent. Thus, for example, reference to "an antioxidant" includes one or more different antioxidants. As used herein, the term "include" and its grammatical variants are intended to be non-limiting, such that recitation of items in a list is not to the exclusion of other like items that can be substituted or added to the listed items.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A method of forming reduced conductivity deposits on spark plugs, said method comprising:

combusting a fuel comprising ferrocene and a manganese-containing compound in an apparatus comprising the spark plugs, the treat rate of the manganese-containing compound ranging from about 1 to about 20 mg of manganese per liter of fuel, the weight ratio of iron metal to manganese metal in the fuel ranging from about 2:36 to 35:36, wherein the apparatus is chosen from spray guided-, wall guided-, and combined wall/spray guided-direct injection gasoline (DIG) engines; turbocharged DIG engines; supercharged DIG engines; homogeneous combustion DIG engines; homogeneous/stratified DIG engines; DIG engines outfitted with piezo injectors capable of multiple fuel pulses per injection; DIG engines with EGR; DIG engines with a lean NOx trap; DIG engines with a lean-NOx catalyst; DIG engines with SN-CR NOx control; DIG engines with exhaust diesel fuel after-injection for NOx control; DIG engines outfitted for flex fuel operation; advanced port-fueled gasoline engines; gasoline-fueled homogeneous charge compression ignition (HCCI) engines; gasoline HCCI-electric hybrid engines; and gasoline-electric hybrid vehicles, wherein the manganese-containing compound is methylcyclopentadienyl manganese tricarbonyl.

2. The method of claim 1, wherein the fuel comprises ferrocene in an amount of from about 1 to about 35 mg of iron per liter of fuel.

3. The method claim 1, wherein the conductivity of the deposit composition is about an order of magnitude less than the conductivity of a deposit composition that would be formed using the same fuel without the manganese containing compound in the same engine combusting process.

4. The method of claim 1, wherein the weight ratio of iron metal to manganese metal in the fuel ranges from 3:4 to less than 1:1.

5. A deposit composition produced by combusting a fuel comprising:

(a) ferrocene and (b) methylcyclopentadienyl manganese tricarbonyl at a treat rate ranging from about 1 to about 20 mg of manganese per liter of fuel, wherein the deposit composition has a conductivity of about an order of magnitude less than the conductivity of a deposit composition that would be formed using the same fuel in the same engine combusting process without the manganese containing compound, and wherein the weight ratio of iron metal to manganese metal in the fuel ranges from about 2:36 to 35:36.

6. The deposit composition of claim 5, wherein the fuel comprises ferrocene in an amount of from about 1 to about 35 mg of iron per liter of fuel.

7. The composition of claim 5, wherein the weight ratio of iron metal to manganese metal in the fuel ranges from 3:4 to less than 1:1.

8. A fuel system comprising (a) a fuel, (b) ferrocene, in an amount of from about 1 to about 35 mg of iron per liter of fuel, (c) methylcyclopentadienyl manganese tricarbonyl at a treat rate ranging from about 1 to about 20 mg of manganese per liter of fuel, and (d) a combustion system combusting said fuel, wherein the fuel system produces a spark plug deposit composition, the conductivity of the deposit composition being less than the conductivity of a deposit composition that would be formed using the same fuel without the manganese containing compound in the same engine combusting process, and wherein the spark plugs are present in an apparatus chosen from spray guided, wall guided, and combined wall/spray guided-direct injection gasoline (DIG) engines; turbocharged DIG engines; supercharged DIG engines; homogeneous combustion DIG engines; homogeneous/stratified DIG engines; DIG engines outfitted with piezoinjectors capable of multiple fuel pulses per injection; DIG engines with EGR; DIG engines with a lean NOx trap; DIG engines with a lean-NOx catalyst; DIG engines with SN-CR NOx control; DIG engines with exhaust diesel fuel after-injection for NOx control; DIG engines outfitted for flex fuel operation; advanced port-fueled gasoline engines; gasoline-fueled homogeneous charge compression ignition (HCCI) engines; gasoline HCCI-electric hybrid engines; and gasoline-electric hybrid vehicles, and wherein the weight ratio of iron metal to manganese metal in the fuel ranges from about 2:36 to 35:36.

9. The fuel system of claim 8, wherein said combustion system is spark ignited or compression ignited.

10. The fuel system of claim 8, wherein said combustion system has a glow plug ignition.

11. The method claim 8, wherein the conductivity of the deposit composition is about an order of magnitude less than the conductivity of a deposit composition that would be formed using the same fuel without the manganese containing compound in the same engine combusting process.

12. The system of claim 8, wherein the weight ratio of iron metal to manganese metal in the fuel ranges from 3:4 to less than 1:1.

13. A method of reducing spark plug misfire in an apparatus comprising spark plugs, said method comprising:

combusting a fuel comprising ferrocene and a manganese-containing compound in the apparatus, the fuel including the manganese-containing compound at a treat rate ranging from about 1 to about 20 mg of manganese per liter of fuel, the weight ratio of iron metal to manganese metal in the fuel ranging from about 2:36 to 35:36, wherein the apparatus is chosen from spray guided-, wall guided-, and combined wall/spray guided-direct injection gasoline (DIG) engines; turbocharged DIG engines; supercharged DIG engines; homogeneous combustion DIG engines; homogeneous/stratified DIG engines; DIG engines outfitted with piezoinjectors capable of multiple fuel pulses per injection; DIG engines with EGR; DIG engines with a lean NOx trap; DIG engines with a lean-NOx catalyst; DIG engines with SN-CR NOx control;

DIG engines with exhaust diesel fuel after-injection for NOx control; DIG engines outfitted for flex fuel operation; advanced port-fueled gasoline engines; gasoline-fueled homogeneous charge compression ignition (HCCI) engines; gasoline HCCI-electric hybrid engines; and gasoline-electric hybrid vehicles, wherein the spark plug misfire is reduced relative to spark plug misfire that would occur in the same method except for using a fuel without a manganese-containing compound, and wherein the manganese-containing compound is methylcyclopentadienyl manganese tricarbonyl.

14. The method of claim 13, wherein the fuel comprises ferrocene in an amount of from about 1 to about 35 mg of iron per liter of fuel.

15. The method of claim 13, wherein the weight ratio of iron metal to manganese metal in the fuel ranges from 3:4 to less than 1:1.

16. A method of preventing spark plug misfire in an engine combusting a fuel comprising ferrocene, said method comprising:

adding a manganese-containing compound to the fuel at a treat rate ranging from about 1 to about 20 mg of manganese/liter of fuel, the weight ratio of iron metal to manganese metal in the fuel ranging from about 2:36 to 35:36, wherein lack of spark plug misfire is identified by the absence of a malfunction indicator light (MIL) code on an on-board diagnostic system (OBD) connected to the engine, wherein the manganese-containing compound is methylcyclopentadienyl manganese tricarbonyl.

17. The method of claim 16, wherein the fuel comprises ferrocene in an amount of from about 1 to about 35 mg of iron per liter of fuel.

* * * * *